United States Patent [19]

Corse

[11] 4,249,316

[45] Feb. 10, 1981

[54] METHOD AND INSTALLATION FOR DRYING MOULDED PULVERULENT PRODUCTS

[75] Inventor: Louis G. Corse, Chaumont-sur-Tharonne, France

[73] Assignee: Machines Chambon, Orleans, France

[21] Appl. No.: 964,494

[22] Filed: Nov. 29, 1978

[30] Foreign Application Priority Data

Dec. 12, 1977 [FR] France ..... 77 37328

[51] Int. Cl.[3] ..... F26B 3/04; F26B 15/10

[52] U.S. Cl. ..... 34/28; 34/34; 34/189; 34/212; 34/216; 127/63

[58] Field of Search ..... 34/149, 189, 190, 46, 34/48, 28, 212, 213, 214, 216, 217, 34; 127/63; 426/454, 465; 99/475, 477, 478, 483

[56] References Cited

U.S. PATENT DOCUMENTS

| | | | |
|---|---|---|---|
| 1,481,116 | 1/1924 | Ayres et al. | 34/216 |
| 1,567,031 | 12/1925 | Buensod | 34/216 |
| 1,675,260 | 6/1928 | Edmunds | 34/190 |
| 1,751,472 | 3/1930 | Criqui | 34/28 |
| 3,371,428 | 3/1968 | Thygeson, Sr. et al. | 34/216 |
| 3,756,855 | 9/1973 | Duchateau et al. | 127/63 |

*Primary Examiner*—Larry I. Schwartz

*Attorney, Agent, or Firm*—McAulay, Fields, Fisher, Goldstein & Nissen

[57] ABSTRACT

This installation for drying, by controlled evaporation, humidified and agglomerated caster sugar comprises an oven with a plurality of sections. Conveying means are provided for passing the products to be dried successively through these sections, between the entrance and exit of the oven. Means are provided for extracting the air, said means being connected to the median part of the oven, in order permanently to suck in the ambient air through the entrance and exit of the oven, which are left free. In each section of the oven means are also provided for producing an auxiliary air stream oriented perpendicularly to the direction of displacement of the products to be dried.

9 Claims, 3 Drawing Figures

3
I
II
III
IV
V
VI
VII
VIII
T°c
HR%
WATER INJECTION
YES
NO
Ta
Tr
RH
t mn.

METHOD AND INSTALLATION FOR DRYING MOULDED PULVERULENT PRODUCTS

BACKGROUND OF THE INVENTION

The present invention relates to a method and installation for drying moulded pulverulent products, by controlled evaporation, this method and installation being more particularly applicable to the drying of humidified and agglomerated caster sugar.

Ovens are already known, particularly sugar drying ovens, of which the climatic conditions are defined to decelerate or prevent drying in certain sections thereof. These ovens are rendered heat-proof and air-tight in order to be able to control, with precision, the conditions of temperature and humidity. These ovens therefore present a certain number of drawbacks since they require an air lock or like devices where the product enters and leaves, in order to maintain the tightness of the whole, as well as the precise preconditioning of the product to avoid thermal shocks and condensation on entering the oven.

Furthermore, the cost of such installations is particularly high.

SUMMARY OF THE INVENTION

It is essentially an object of the present invention to remedy these drawbacks by providing a method and installation enabling the climatic conditions in the various sections of the oven to be monitored without having to deal with particularly critical problems of seal.

To this end, this method of drying, by controlled evaporation of moulded pulverulent products, particularly humidified and agglomerated caster sugar, in which the products to be dried are displaced through a plurality of successive sections of an oven in which the temperature and relative humidity of the air are regulated, is characterised in that the products to be dried are swept by a main air current flowing in the same direction as the direction of displacement of the products in the first part of the sections of the oven and in the opposite direction in the second part of the oven, and the products to be dried are further swept, in each section, by an auxiliary air current, directed perpendicularly to the direction of displacement of the products, in order to homogenise the atmosphere in each section.

According to a further feature of the invention, in the first sections of slow drying by controlled evaporation, the air is humidified and its rate of flow is adjusted to a relatively low value, whilst in the last section or sections of rapid drying, the auxiliary air is not humidified and its rate of flow is adjusted to a relatively high value.

It is also an object of the invention to provide an installation for drying, by controlled evaporation, moulded pulverulent products, particularly humidified and agglomerated caster sugar, comprising an oven with a plurality of sections, means for monitoring the temperature and relative humidity of the air in these various sections, and conveying means for successively passing the products to be dried throught these sections, between the entrance and exit of the oven, said installation comprising means for extracting the humid air connected to the median part of the oven, in order, permanently, to suck in the ambient air throught the entrance and exit of the oven, which are left free, and, in each section, means for producing an auxiliary air current oriented perpendicularly to the direction of displacement of the products to be dried.

The method and installation according to the invention offer the advantage that they make it possible to obtain, without noteworthy complication of the installation, moulded and dried products bereft of any phenomenon of crusting or cracking which generally appears in rapid drying ovens. They avoid having to resort to complex sealing devices at the entrance and exit of the oven. Furthermore, the interior of the oven is placed under partial vacuum by the extraction means, this avoiding leakages of humid air and consequently trickling on the outer walls of the oven.

Due to the method according to the invention, the temperature and humidity at the entrance of the oven develop progressively from ambient conditions to the conditions chosen for drying, this eliminating the risks of condensation on the products to be dried. On the product exit side, the fresh air which arrives is progressively heated without humidification, this provoking a final, rapid drying of the products and cooling at the exit.

Inside the oven, the main and auxiliary air currents give a resulting current which propagates spirally, and ensures a constant mixing and a good homogeneity in humidity and termperature, during the phase of drying by controlled evaporation.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
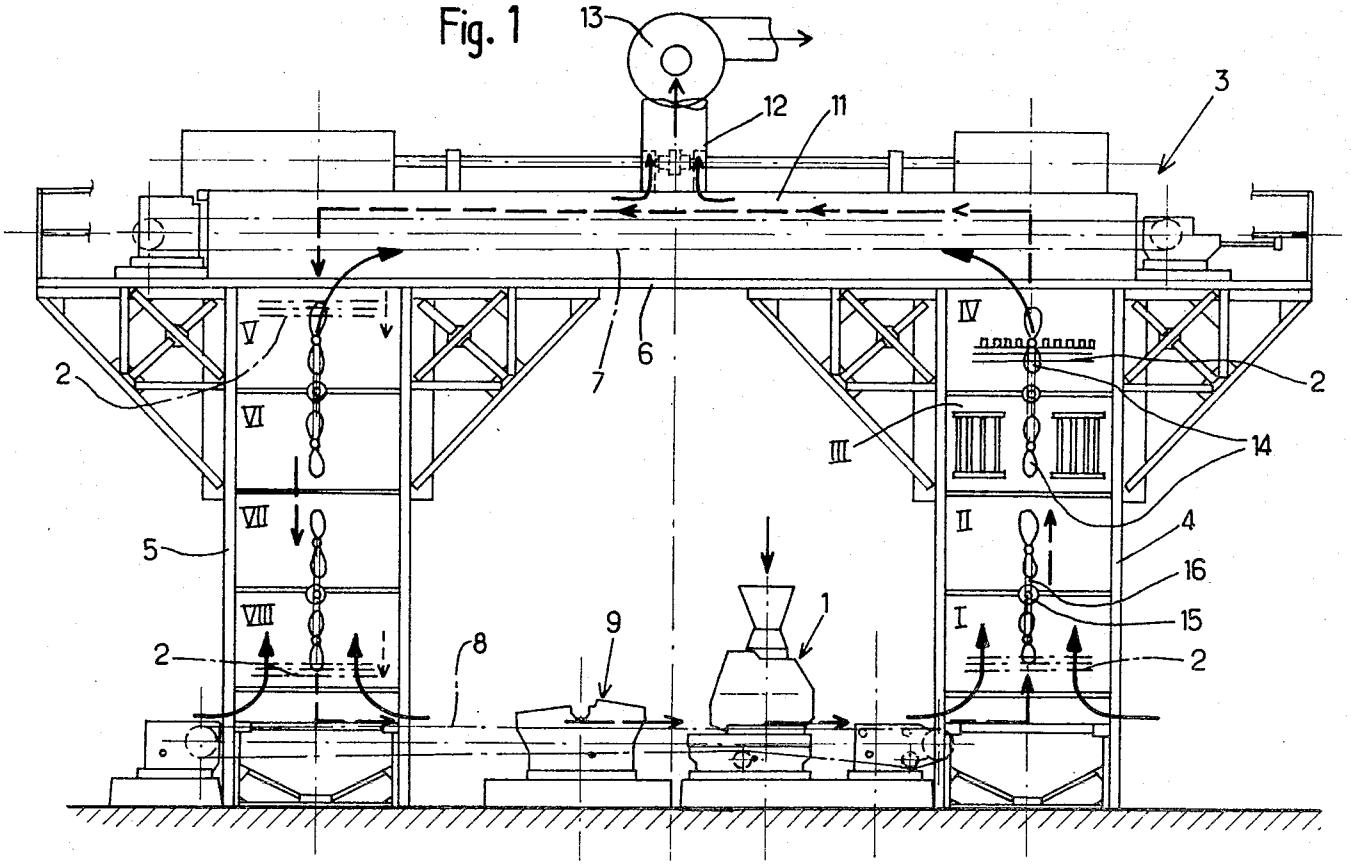
FIG. 1 is a schematic view of elevation of an oven in which is carried out the method of drying by controlled evaporating according to the invention.

In the following specification, the problem of drying blocks of sugar lumps, loaves and the like, moulded from humidified and agglomerated caster sugar in a moulding machine generally indicated by 1, will be more particularly considered. The sugar lumps are carried by horizontal plates 2 which are introduced into a drying oven generally designated by 3. This oven comprises a metal frame constituted by two columns 4 and 5 between which extends an upper bridge 6. In the columns 4 and 5 are housed respectively ascending and descending bucket elevators, for raising and lowering the plates 2, whilst the bridge 6 bears an upper conveyor 7 for passing the plates from the top of the ascending bucket elevator column 4 to the top of the descending bucket elevator column 5. At the bottom of the descending bucket elevator column 5, the plates are taken by a lower conveyor 8 which takes the dried sugar lumps to a packing machine 9. Their path is shown diagramatically by broken arrows.

The plates 2 carrying the sugar lumps to be dried and which leave the moulding machine 1 are introduced at the base of the ascending bucket elevator column 4 which comprises four superposed section I, II, III, IV. The superposed plates 2 thus pass successively throughout these four sections until they reach the right-hand end of the upper conveyor 7, which then takes them and moves them towards the left as far as the top of the descending bucket elevator column 5. This column 5 successively comprises, from top to bottom, four sections V, VI, VII, VIII. The plates 2 carrying the dried sugar lumps leave the column 5 at the bottom thereof and are then displaced by the conveyor 8 to the packing machine 9.

The oven 3 has a considerable main air stream passing therethrough of which the path is materialised by solid-line arrows. This airstream is for example equal to four times the minimum stream necessary for evacuating all the humidity from the sugar. This air stream is formed by the ambient air sucked in at the base of the two columns 4 and 5 and which follows therein a vertical ascending path. This air stream is then channeled, at the top of the oven 3, in a horizontal shaft 11 extending over the bridge 6 and covering the upper conveyor 7. This shaft 11 is connected in its central part, to an evacuation pipe 12 on which is connected an extractor fan 13 which thus rejects the relatively hot, damp air into the atmosphere.

It is therefore seen, from the above, that the oven 3 according to the invention does not comprise any inlet and outlet air lock, the plates 2 carrying the sugar lumps entering freely into the ascending bucket elevator column 4 at the bottom thereof and freely leaving the descending bucket elevator column 5 at the bottom thereof.

Figure 2:
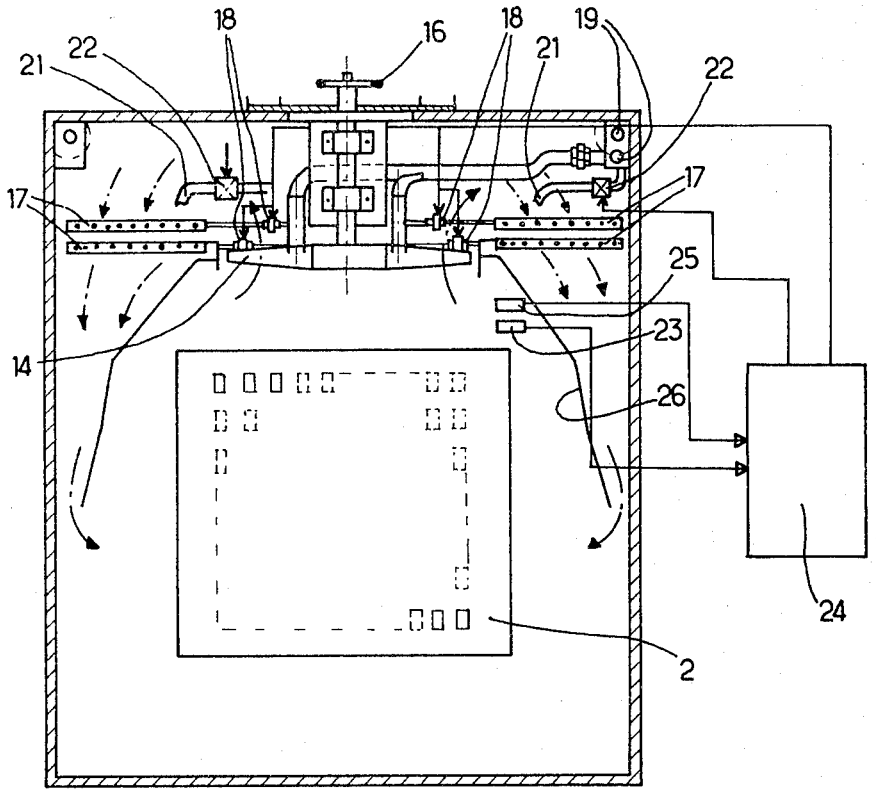
FIG. 2 is a view in horizontal section, on a larger scale, of a section of the oven.

Furthermore, the oven 3 comprises, in each of its sections I to VIII, means for producing an auxiliary air stream oriented perpendicularly to the path followed by the plates 2 carrying the sugar lumps. To this end, each of the sections I to VIII comprises a fan 14 of horizontal axis intersecting the vertical axis of the path followed by the plates 2. This fan 14 is rotated by a motor 15, via a belt 16, this motor 15 being able to be used to drive the fans of two adjacent sections, as is illustrated in FIG. 1. In each of the sections of the oven, the fan 14 ensures the mixing in closed circuit of an auxiliarly air stream which follows the path indicated by the dashed and dotted arrows of FIG. 2. In each section of the oven 3, there are provided heat exchangers 17, for example of the steam type, connected by control valves 18 to steam-supplying pipes 19. Steam injectors 21 are also connected to these pipes, the supply of which injectors being controlled by valves 22. The air stream mixed by each fan 14 is thus heated upon its passage on the heat exchanger so as to be taken to a temperature which is monitored by means of a heat probe 23 connected to a control desk of the oven. A humidity probe 25 in each section is also connected to this desk. The quantity of steam injected by means of the injectors 21 and the temperature of the heat exchangers 17 may thus be monitored as a function of reference values displayed in the general control desk 24. Inside each section of the oven there is disposed a screen 26 which channels the auxiliary air stream, so that said latter circulates in closed circuit, sweeping the sugar lumps to be dried which are carried by the plates 2 and then passing over the heat exchangers 17.

It is therefore seen from the preceding description that theoretically there are two air streams in each sections of the oven 3, namely a main air stream flowing parallel to the path of the sugar lumps to be dried and an auxialiary air stream perpendicular to this path. In fact, a resultant flux is produced which propagates spirally from the entrance and exit of the oven to the centre of the upper shaft 11 where the extractor fan 13 is connected. This progressive propagation of the resultant air flux from section to section presents certain advantages. Firstly, at the entrance of the oven 3, the temperature and humidity develop progressively from ambient conditions to the conditions chosen for drying. The sugar lumps to be dried are therefore progressively brought into suitable state, at the same time as the air, this eliminating risks of condensation. This constitutes a phase of preconditioning which is carried out in the first section I.

Where the sugar lumps leave the oven, the fresh air penetrating in the column 5 of the oven is progressively heated with no other humidification than that provoked by the water coming from these lumps. In fact, no steam is injected in the last two sections VII and VIII of the oven, with the result that a final, rapid drying of the sugar lumps and cooling thereof at the exit of the oven is obtained. The last two sections VII and VIII therefore correspond to an accelerated drying phase.

In the other sections II, III, IV, V and VI of the oven, the spiral propagation of the resultant air stream ensures a constant mixing and consequently a good homogeneity in humidity and temperature; in these sections, a relative slow drying phase with controlled evaporation takes place to obtain a better final appearance of the products.

It should be noted that the extractor fan forms a partial vacuum in the oven 3, this avoiding leakages of humid air, and therefore trickling on the outer walls of the oven, An example of application of the method and installation according to the invention to the manufacture of moulded sugar of the "hard, non-crusted" type, will now be given.

The oven given by way of example has a capacity for producing this type of sugar of 600 kg/hr., this sugar having, on entering, a humidity of about 2% and, on leaving, 0,3%, hence a quantity of water to be evacuated of 10.2 kg/hr.

In the eight sections of the ovens, the following conditions prevail;

Preconditioning section I: T=72° C. and RH=60% (T being the temperature and RH the relative humidity.)

Figure 3:
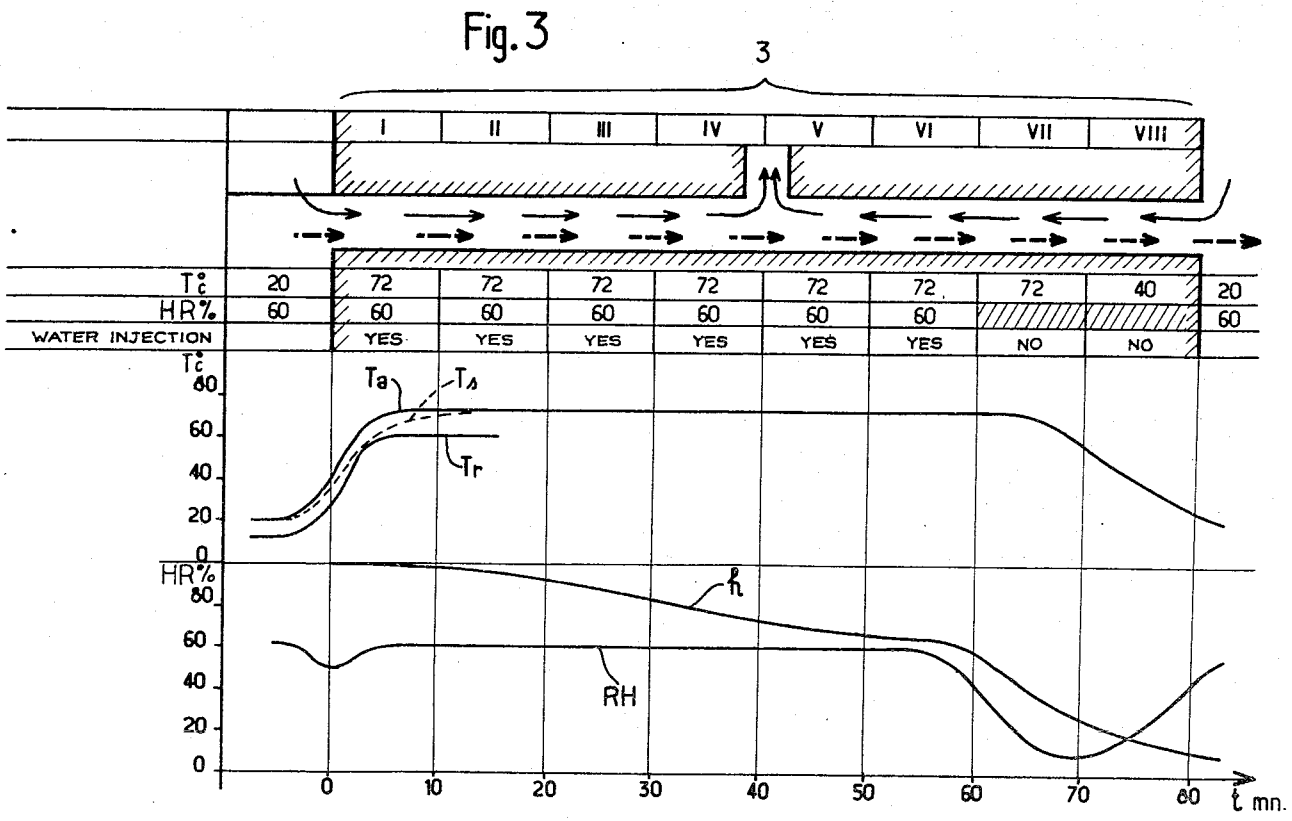
FIG. 3 is a diagram illustrating the variation of the temperature and humidity in the various sections of the oven.

Sections II, III, IV, V, VI for drying under controlled evaporation:

T=72° C. and transitory RH=60%;

Section VII for accelerated drying and cooling: T=72° C. and minimum RH;

Section VIII for accelerated drying and cooling: T=40° C. and normal RH;

The climatic conditions are indicated in the diagram of FIG. 3 established for ambient conditions corresponding to T=20° C. and RH=60%.

The climatic conditions in the various sections, and especially in the first section I are adjusted so that the temperature of the sugar and the support plates 2 always remains higher than the dew point, at the corresponding point, in order to avoid condensations.

The dwell time of the sugar in each section is 10 minutes, in other words, the total dwell time of the sugar in the oven is 80 minutes In the first six sections I to VI, drying must be slow. To this end, the fans 14 are regulated so that they rotate sufficiently slowly to obtain an efficient mixing, with a minimum evaporation of the water contained in the sugar. The speed of the auxiliary air stream in each of these sections is of the order of 0.3 m/s.

In the last two sections VII and VIII for rapid drying, the fans are regulated so that they rotate at high speed in order to promote the evaporation of the water contained in the sugar. the speed of the auxiliary air stream in these sections may be about 1.5 m/s.

As the ambient air is at a temperature of 20° and a relative humidity of 60%, it consequently contains 10.4 g of water per $m^3$.

The air extracted at the top which is, itself, at a temperature of 72° and which has a relative humidity of 60%, contains 129.4 g of water per $m^3$. The overall resultant air stream must therefore be able to evacuate 119 g/$m^3$, at a rate of 10.2 kg/h of water. The minimum rate of flow of the resultant air stream extracted by the fan 13 is therefore 86 $m^3$/h. A safety factor of 4 is chosen, so that the rate of flow of the extractor fan 13 is 350 $m^3$/h.

To maintain the humidity in the oven, it is necessary to supply 10.2×3#31 kg of steam per hour, in other words three parts taking into account one part supplied by the water of the sugar.

The diagram of FIG. 3 indicates the variation, as a function of the time t indicated in minutes on the one hand, the temperature $T_a$ of the air, the temperature $T_s$ of the sugar and the dew point $T_r$, in the various sections of the oven, and, on the other hand, the variation of the humidity h of the sugar and the relative humidity RH of the air, these values resulting from the adjustments adopted, the climatic conditions outside the oven and the humidity supplied by the sugar. The conditions indicated hereinabove correspond to a much decelerated type of drying enabling a product of very good quality to be obtained, in other words a hard, non-crusted sugar. However, it is possible, by means of the installation according to the invention, to obtain more rapid drying conditions, to the detriment of the quality of the product, but enabling the production of the installation to be increased For example, the first four sections I to IV may be allocated to preconditioning and to controlled evaporation and the last four sections V to VIII to rapid drying. The speed of passage in the oven may then be doubled and a production of 1200 kg/h of a lower quality sugar may thus be obtained.

All the oven may also be regulated for accelerated drying, this allowing a production of 2400 kg/h to be obtained. A normal production of ordinary quality sugar is then obtained.

It is seen that the installation according to the invention enables the quality and quantity of the production to be adapted to the different needs of the clientele. The passage from one type of production to another is made by modifying the climatic regulation of each of the sections of the oven, by modifying the speeds of the fans to give them either a function of mixing (low speed) or a function of evaporation accelerator (high speed) and by modifying the speeds of circulation of the sugar lumps, to regulate the speeds of production.

What I claim is:

1. A method for drying moulded pulverulent products, particularly humidified and agglomerated caster sugar by controlled evaporation, comprising:

displacing the products to be dried through a plurality of successive sections of an oven in which the temperature and relative humidity of the air is regulated;

sweeping the products to be dried by means of a main air stream flowing in the same direction as the direction of displacement of the products in a first part of the oven and in an opposite direction in a second part of the oven;

further sweeping the products to be dried in each section of said plurality of sections by an auxiliary air stream which is directed perpendicularly to the main air stream and the direction of the products in order to homogenize the atmosphere in each section of said plurality of sections;

humidifying the auxiliary air in all but the last two sections of said plurality of sections for slow drying by controlled evaporation;

adjusting the rate of flow of the humidified auxiliary air stream in a penultimate section of said plurality of sections to a relatively low value; and, adjusting the rate of flow of the auxiliary air in an ultimate section after it leaves said penultimate section to a relatively high value without humidifying thereof.

2. The method as claimed in claim 1, wherein the oven has eight sections, and including:

regulating the temperature in the first six sections so that the caster sugar is preconditioned at a temperature of about 72° C. and a relative humidity of 60%;

regulating the temperature in the seventh section which is said penultimate section for accelerated drying and cooling at a temperature of about 72° C. and minimum relative humidity; and, regulating the temperature in the eighth section which is said ultimate section to a temperature of approximately 40° C. and normal relative humidity, wherein the ambient conditions are such that the temperature is approximately 20° C. and the relative humidity is 60%.

3. The method as claimed in claim 1, wherein the oven has eight sections and said penultimate section is the seventh section and said ultimate section is said eighth section, and including:

regulating the speed of the auxiliary air stream to provide for controlled evaporation in the first six sections so that the speed of the auxiliary air stream in each of the aforesaid sections is of the order of 0.3 m/3; and, regulating the speed of the auxiliary air stream in the last two sections so that the speed of the auxiliary air stream is about 1.5 m/s to provide for the rapid drying of the caster sugar.

4. An installation for drying moulded pulverulent products particularly humidified and agglomerated caster sugar by controlled evaporation, comprising:

an oven with a plurality of sections;

means for monitoring the temperature and relative humidity of the air in said plurality of sections;

conveying means for passing the products to be dried successively through said plurality of sections between the entrance and exit of said oven;

means connected to the median part of said oven for extracting the air in order permanently to suck in the ambient air through the entrance and exit of the oven which are left free so as to create a main air stream in the direction of product movement;

means in each section for producing an auxiliary air stream oriented perpendicularly to the main air stream direction of displacement of the of the products to be dried;

means associated with each of the plurality of sections except the last two of said plurality of sections of said oven for humidifying the auxiliary air stream to ensure preconditioning and slow drying by controlled evaporation;

means associated with at least one of the last two of said plurality of sections of said oven for adjusting the rate of flow of the auxiliary air stream to a relatively high value without humidification of the auxiliary air stream; and a humidity probe connected to a central control desk and to members for regulating said humidification means.

5. An installation as claimed in claim 4, wherein each of the sections of said oven comprises:

a fan having a transverse axis with respect to the direction of the path followed by the products to be dried;

a motor for driving said fan at an adjustable speed; and, means for heating the auxiliary air to a predetermined temperature.

6. An installation as claimed in claim 5, further comprising:

a screen in each said section for channeling the auxiliary air stream created by said fan in a closed circuit.

7. An installation as claimed in claim 5 or 6, comprising:

a heat probe in each of said sections connected to a central control desk connected to the members for regulating said heating means.

8. An installation as claimed in claim 5, wherein said means for heating the auxiliary air stream comprises at least an inner or an outer heat exchanger.

9. An installation as claimed in claim 8, wherein said humidification means includes:

said heat exchanger which is of the steam type; and, a steam supplying pipe connected with said heat exchanger, and a steam ejector connected with said steam supplying pipe.

* * * * *